United States Patent [19]

Lecomte et al.

[11] 4,253,780

[45] Mar. 3, 1981

[54] METHOD OF POSITIONING A FLARE SUPPORT STRUCTURE FOR A PETROLEUM PLATFORM

[75] Inventors: Claude Lecomte, Saint Herblain; Daniel Fleury, Nantes, both of France

[73] Assignee: Ateliers et Chantiers de Bretagne ACB, Nantes, France

[21] Appl. No.: 14,868

[22] PCT Filed: Feb. 26, 1979

[86] PCT No.: PCT/FR78/00005

§ 371 Date: Feb. 28, 1979

§ 102(e) Date: Feb. 26, 1979

[87] PCT Pub. No.: WO79/00016

PCT Pub. Date: Jan. 11, 1979

[30] Foreign Application Priority Data

Jun. 29, 1977 [FR] France ..... 77 20033

[51] Int. Cl.[3] ..... E02B 17/00

[52] U.S. Cl. ..... 405/202; 14/77; 405/203; 405/205

[58] Field of Search ..... 405/206, 202, 205, 207, 405/203, 208, 218, 219, 220, 221, 225; 14/75, 77, 71.1

[56] References Cited

U.S. PATENT DOCUMENTS

| | | | |
|---|---|---|---|
| 2,564,123 | 8/1951 | Melges et al. | 405/221 |
| 3,036,438 | 5/1962 | Sims | 405/206 |
| 3,178,892 | 4/1965 | Stimson | 405/206 X |
| 3,568,451 | 3/1971 | Gustin | 405/221 |
| 4,106,302 | 8/1978 | Vogel | 405/205 X |
| 4,141,668 | 2/1979 | Engel | 405/202 |
| 4,152,088 | 5/1979 | Vilain | 405/205 X |

FOREIGN PATENT DOCUMENTS

| | | | |
|---|---|---|---|
| 2514522 | 10/1976 | Fed. Rep. of Germany | 405/206 |
| 573027 | 11/1945 | United Kingdom . | |

*Primary Examiner*—Stephen J. Novosad
*Attorney, Agent, or Firm*—Frost & Jacobs

[57] ABSTRACT

The invention relates to a method for positioning a support structure for installations outside a petroleum platform and to said support structure.

The structure comprises a biped tower (2) supporting a bridge (1) which supports a flare (3) at one of its ends. The structure, in folded towing position, floating by means of floats (26) and dead men (10), is towed to the site, the tail of the structure is supported by the platform (40), and the dead men (10) and then the floats (26) are ballasted when the tower (2) is in vertical position. When the feet of the tower rest on the ocean bed (11) the tail is hoisted onto the platform (40) in order to anchor it to the latter and the floats (26) are recovered.

The invention is applied to a flare support for a marine platform.

6 Claims, 9 Drawing Figures

METHOD OF POSITIONING A FLARE SUPPORT STRUCTURE FOR A PETROLEUM PLATFORM

Figure 1:
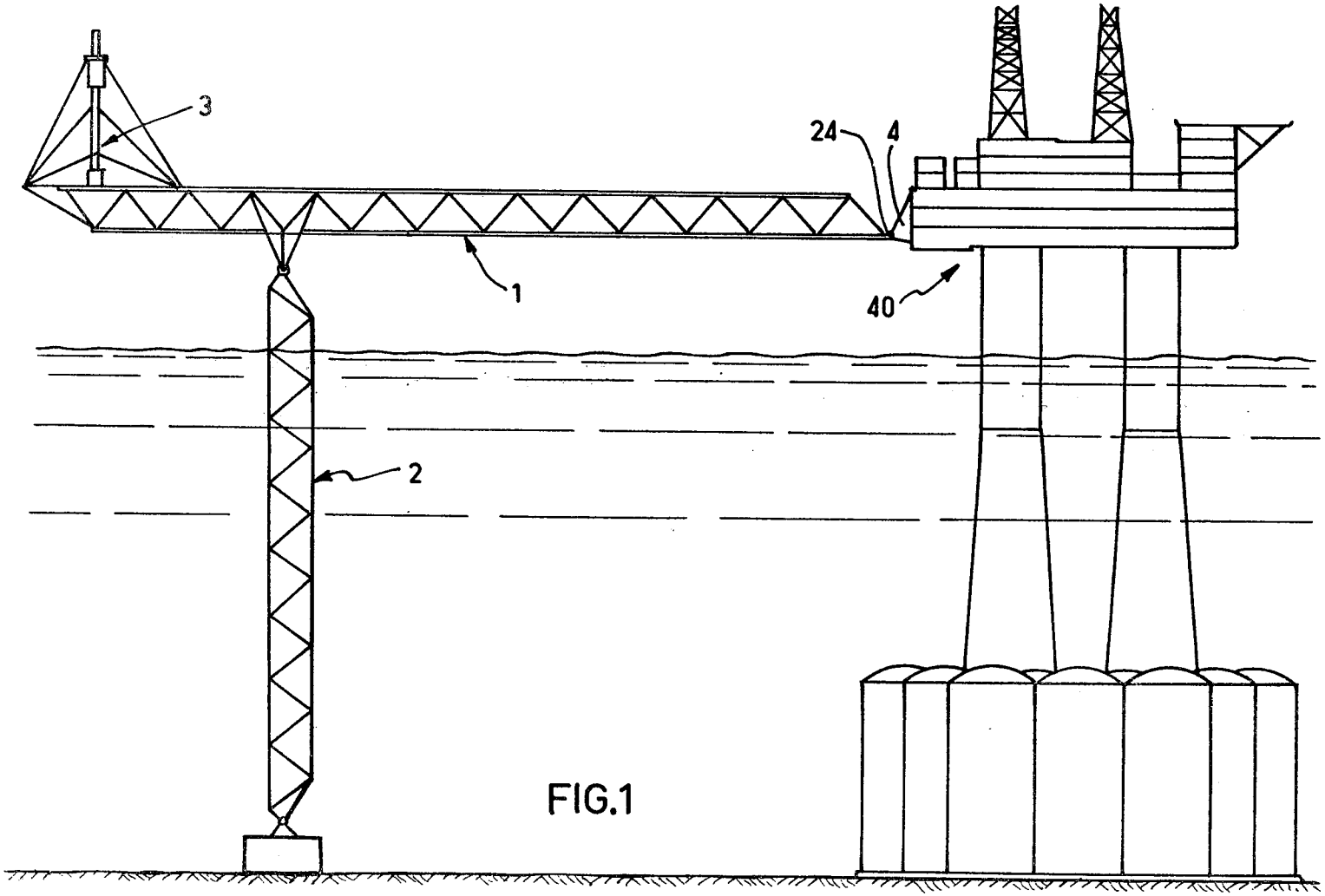

The present invention relates to a method for positioning a structure supporting installations on the outside of marine platforms, this structure including a biped tower supporting a bridge which itself supports a flare or any other installation at one of its ends and is provided with connection means to the platform at the other end.

Generally, this type of structure including a support tower comprises at the foot of said tower, a concrete mass arranged to rest on the ocean bed. This concrete foot weighs about 14,000 tons and accordingly the placing of such an installation in operation is very long and delicate.

It is an object of the present invention to overcome the drawbacks of known tower structures, notably the drawbacks on placing them in position.

To this end, it is an object of the invention to provide a support structure suitable for supporting the bridge on one end of which is fixed a flare or any other installation, this structure being such that its placing in position can be effected with a minimum of means, while permitting this operation to be carried out with the minimum of risk and maximum of reliability.

The invention relates to a method of placing in position a support structure for installations outside a petroleum platform, notably a flare support structure, said structure comprising a biped tower supporting a bridge which supports a flare at one of its ends, said method being characterized in that the whole of the structure is folded into a configuration facilitating its towing, the biped tower being brought by rotation beneath the bridge, this assembly is floated into towing arrangement by means of auxiliary floats and by removing the ballast from the dead men, this assembly is towed to the site, the end of the bridge opposite the flare or tail is supported by the platform, the dead men are partly ballasted to submerge them, the assembly is positioned at the desired point when the biped tower is in vertical position, the ballasting of the dead men is terminated, ballasting of the auxiliary floats is commenced to place the foot of the biped tower on the ocean bed, the tail of the bridge is hoisted from the platform in order to anchor it to the latter and the auxiliary floats are recovered.

It is also an object of the invention to provide a support structure for outer installations with flares for petroleum platforms, notably a flare support structure comprising a biped tower supporting a bridge which supports a flare at one of its ends, said structure being characterized in that it includes connecting means articulated between the bridge and the two legs of the biped tower enabling rotation of at least about 90° around an axis transverse to the bridge and substantially parallel to the surface of the water, in that the biped tower includes two feet resting on two boxes or caissons through articulations pivoting around an axis parallel to the axis of rotation of the connecting means, said boxes being ballastable.

It has already been proposed, in Patent Application DE 2,514,522 or in GB 573,027 to provide platforms having feet which are folded during transportation and which are brought to a position close to the vertical at the moment of positioning, but this relates then to autonomous structures, designed to be installed far from any other structure and which are held in position, during the operation of pivoting the feet, by anchoring cables. Such a solution is not suitable for a structure which must be attached to a pre-existing platform, and be positioned close to the latter and without causing it to be subjected to large stresses either during positioning or after installation.

Figure 2:
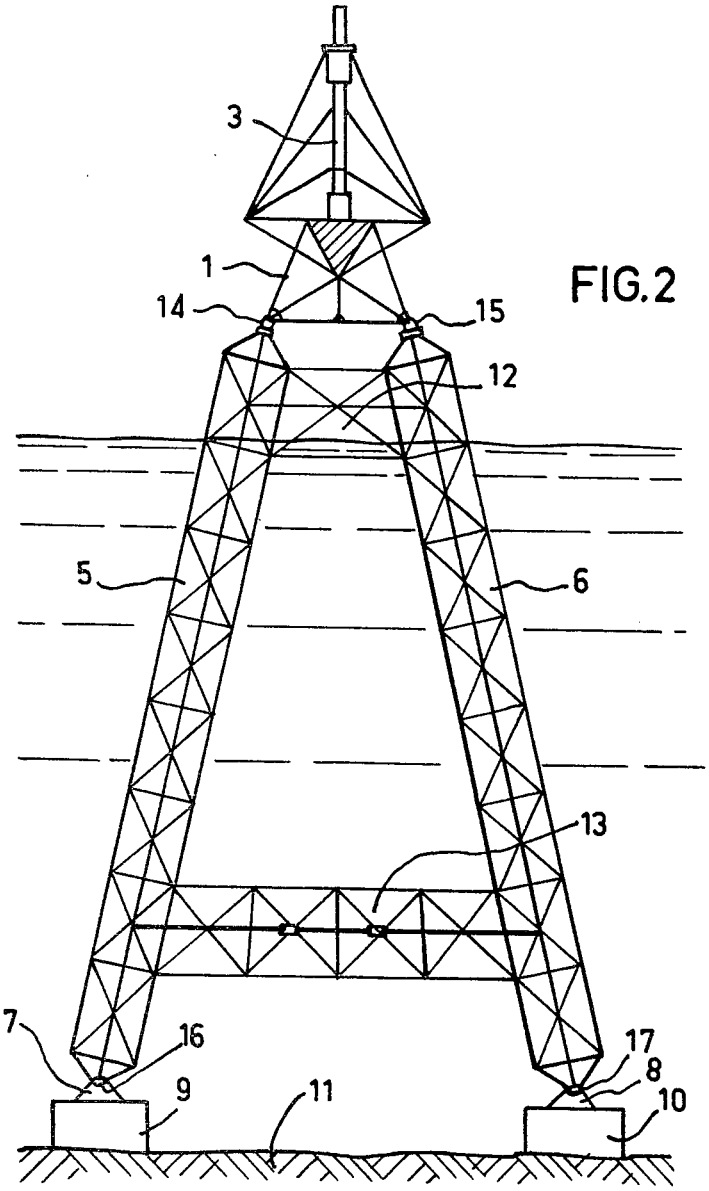
Figure 3:
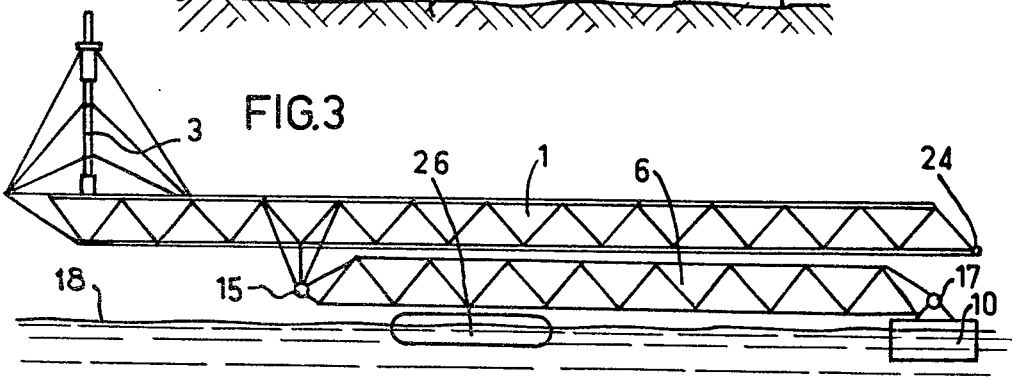
Figure 4:
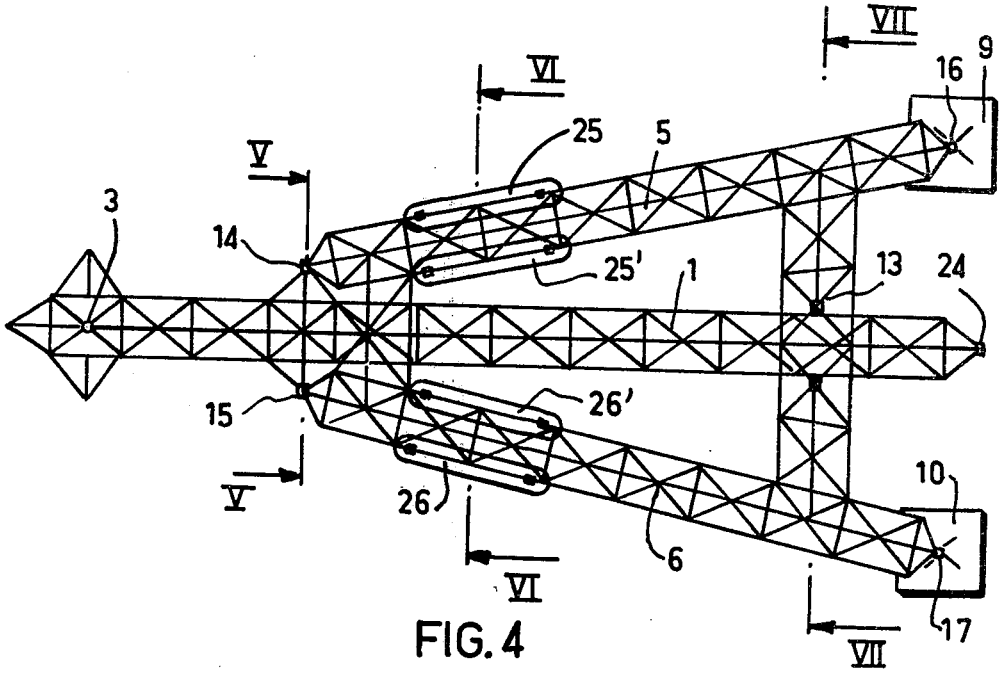
Figure 5:
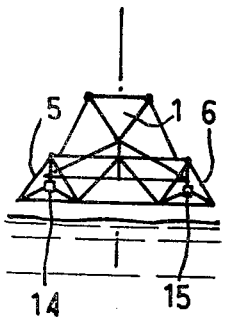
Figure 6:
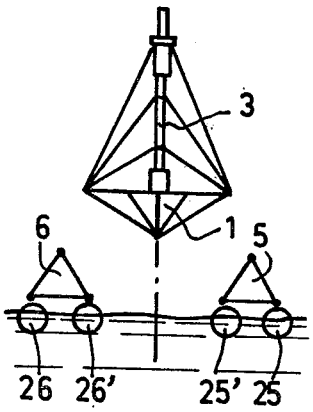
Figure 7:
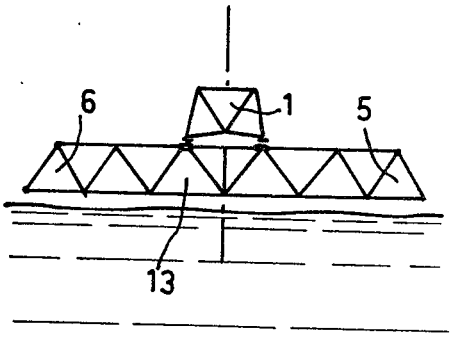
Figure 8A:
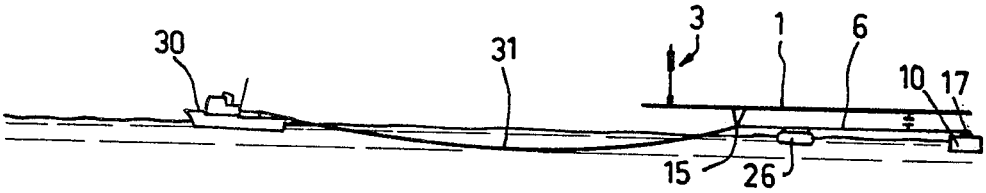
Figure 8B:
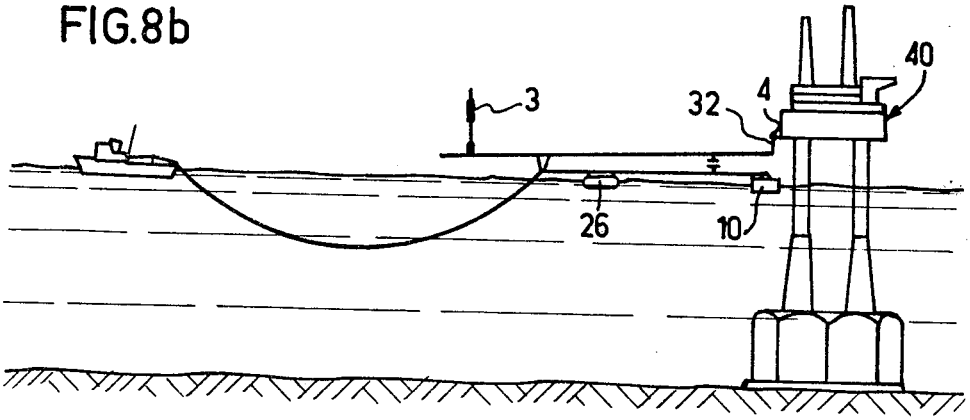
Figure 8C:
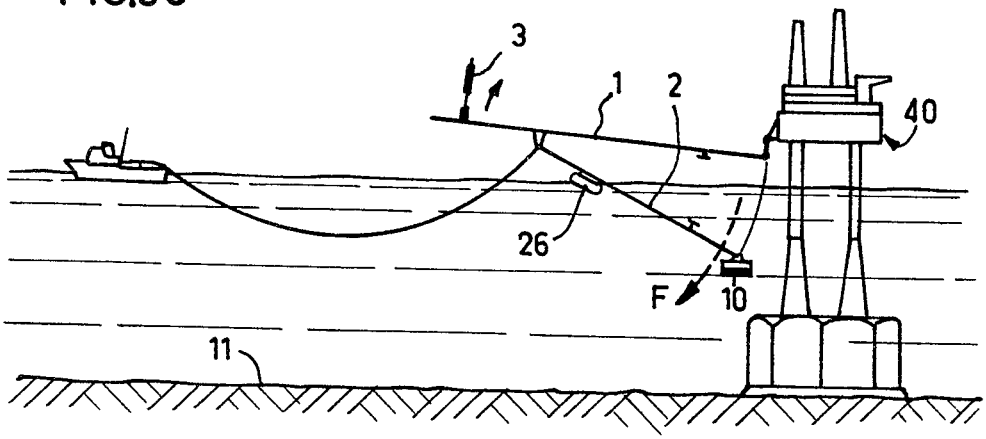
Figure 8D:
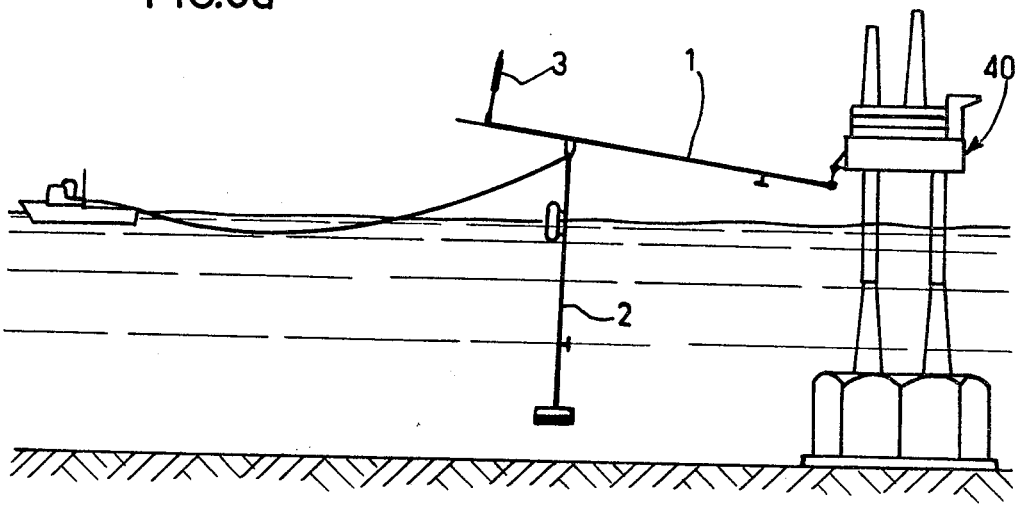
Figure 8E:
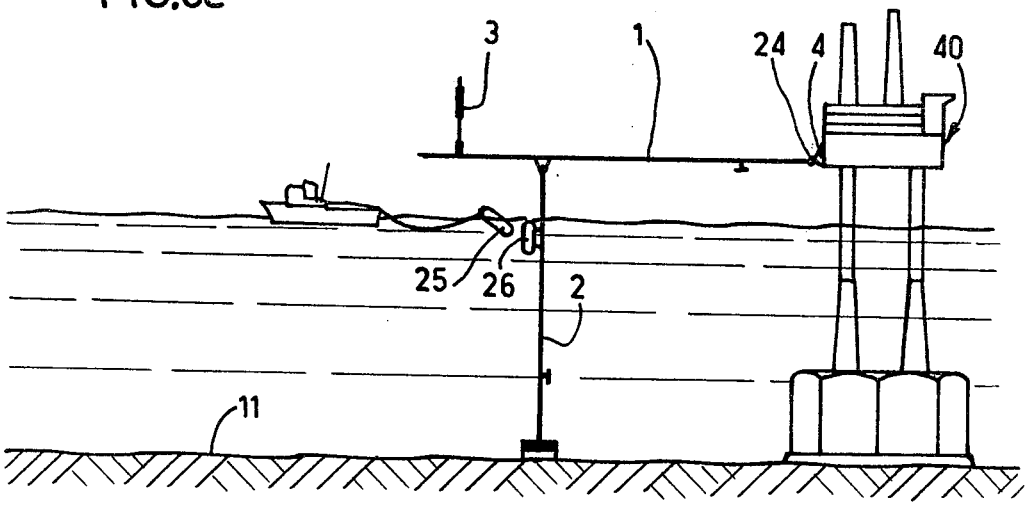
Figure 9:
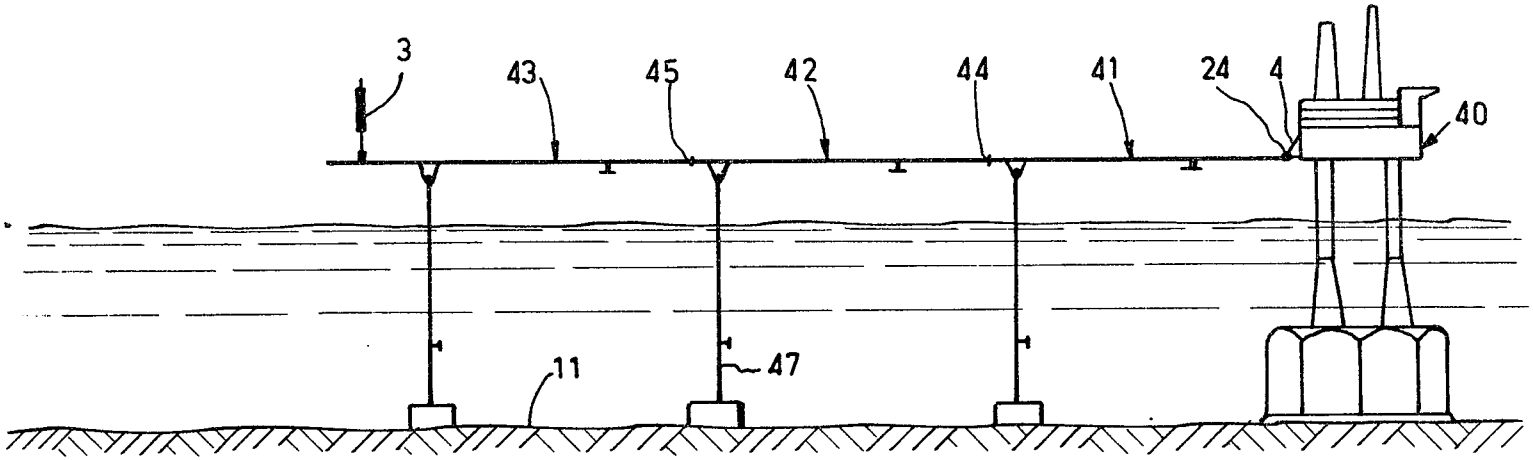

Other advantages and characteristics of the invention will be demonstrated in the description which follows given by way of non-limiting example, with reference to the accompanying drawing in which:

FIG. 1 is a diagrammatic view of the side of a structure positioned according to the invention, FIG. 2 is a front view of the biped tower according to the invention, FIG. 3 is a side view of the structure according to the invention in towing position, FIG. 4 is a view from above of the structure in towing position shown in FIG. 3, FIG. 5 is a section along the line V—V of FIG. 4, FIG. 6 is a section along the line VI—VI of FIG. 4, FIG. 7 is a section along the line VII—VII of FIG. 4, FIGS. 8*a* to 8*e* are diagrams showing the operations of positioning of the structure according to the invention, FIG. 9 is a diagrammatic view from the side of another embodiment according to the invention.

In FIG. 1 is shown a structure according to the invention after its placing in position. This structure includes essentially a horizontal beam or bridge 1 and a biped tower 2 supporting said bridge.

The bridge is constituted according to conventional techniques from a network of steel tubes. In the embodiment shown, the length of the bridge is about 180 m, its weight about 900 tons and its cross-section is triangular with sides of about 12 m. The bridge 1 supports, at the end remote from the working platform 40, a flare 3 whose height is 35 m and weight 45 tons.

The bridge 1 includes at its other end, connecting means 24 arranged so as to be fastened to an anchoring support 4 itself fastened to the working platform 40. This anchoring support 4 includes a jib which is constructed of steel tubes and receives the rotary joint provided for the gas line for the flare. The weight of the whole of this structure is about 70 tons.

By means of FIGS. 1 and 2, the biped tower will also be described, also constituted, according to conventional techniques, of a network of steel tubes. The two legs 5 and 6 of the tower have a triangular cross-section of side about 10 m. The tower provided for a depth of water of about 120 m has a height of 130 m and its total weight is 1100 tons. It is well understood that, according to another embodiment of the invention, it is easily possible to install a biped tower with greater depth. The two lower ends 7 and 8 of the tower are separated by about 80 m and rest through two pivots 16 and 17 on two boxes or caissons 9 and 10 which are themselves supported on the ocean bed 11. The biped tower includes two transverse cross members 12 and 13 also of a tubular steel network. The two boxes 9 and 10 are of steel and can be loaded with concrete, their sizes are about 12 m×12 m×6 m and the total weight of a caisson in air is about 700 tons.

The two legs 5 and 6 of the tower each include at their upper end a pivot 14, 15 respectively connected to each lower corner of the bridge 1.

The pivots 14 and 15 between the tower and the bridge as well as those 16 and 17 between the tower and the caissons are simple axles or ball joints which, as will be specified below, only operate once, during the placing in position.

By means of FIGS. 3 to 7, the structure according to the invention in towing position will now be described.

The whole of the structure is installed so that the biped tower 2 is folded towards the bridge 1 on the side of the anchoring support 4 by rotating around the axis passing through the two pivots 14 and 15. The longitudinal axes of the two legs of the tower are substantially parallel to the longitudinal axis of the bridge 1 as well as to the water level 18. The caissons 9 and 10 have also pivoted around their pivots 16 and 17 so that a portion of each caisson is situated beneath the end of each leg of the tower.

Each leg 5 or 6 is provided with two floats 25, 25' and 26, 26' for the towing and positioning. These four floats are respectively situated parallel, two by two, beneath each leg in the half situated close to the pivoting axis of the bridge. Each float has a generally cylindrical shape with two substantially hemispherical ends. The diameter is about 5.1 m and the length 32 m. Each float has a weight in air of about 130 tons and a net thrust of 490 tons.

The whole of the structure therefore floats by means of the four auxiliary floats 25, 25', 26, 26' whose net total thrust is 1960 tons and by the dead men from which the ballast has been removed, notably the two boxes 9 and 10.

By means of FIGS. 8*a* to 8*e*, all the operations of positioning the structure according to the invention will now be described.

The whole of the structure is installed, folded in the towing arrangement shown in FIGS. 3 to 7 and described above. This installation is done in a protected area having a water draft of about 5 m for example.

This assembly is connected to a tug 30 through a cable 31 fastened at the level of the pivots 14 and 15 and is then towed to the site (FIG. 8*a*).

Once on site, the end of the bridge including the connecting means to the working platform 40 is arranged substantially beneath the jib 4. An anchoring and hoisting cable 32 is fastened to the jib 4 of the platform 40 and to the end 24 of the bridge. This end of the bridge is thus supported by the platform through the cable 32 (FIG. 8*b*).

The dead men are partly ballasted with water, notably the boxes 9 and 10, to submerge them. The latter gradually sink with a pendular movement and cause the straightening, along the arrow F shown in dashed line in FIG. 8*c*, of the biped tower 2 still supported by the four auxiliary floats. During this operation, the floats being still substantially at water level, the flare 3 has a tendency to be lifted above the water.

Once the biped tower 2 is completely upright, that is to say in vertical position (see FIG. 8*d*), the whole is positioned at the desired point, with the assistance of several tugs. The ballasting of the dead men or caissons 9 and 10 with water is then completed, and the ballasting of the auxiliary floats also with water is then started, in order to drop the feet of the biped 2 onto the ocean bed 11.

When the caissons are supported on the ocean bed (See FIG. 8*e*) the tail of the bridge is hoisted, that is to say the end including the connecting means 24 to the platform, in order to anchor said bridge 1 to the platform 40. The auxiliary floats are then recovered. It is also possible to provide for locking the pivots 14, 15, 16 and 17 in the position of the structure at the end of installation.

For the dead men, caissons 9 and 10, simple ballasting with water can suffice, but it is possible also to complete this water ballasting, once the caissons are in position on the ocean bed, with concrete in order to weight the said caissons and thus to fasten the structure according to the invention more positively.

Once all these operations are terminated, the assembly is installed and is ready for marine petroleum exploitation.

By means of FIG. 9, another embodiment of the structure according to the invention will now be described.

For all the installations outside petroleum marine platforms, such as flares, the greater the distance of the flare to the platform, the more satisfactory are the safety conditions. In addition, given a shallower the water depth, the easier and less expensive is the operation of positioning according to the invention, so that in a shallow depth of water it is preferred to provide greater distance of the flare 3 or other installation with respect to the platform 40 by extending the bridge by means of the juxtaposition of several structures 41, 42, 43 according to the invention.

For the positioning of the assembly shown in FIG. 9, one commences by installing the structure 41 directly connected to the platform 40, in the same way as the structure shown in FIGS. 8*a* to 8*e* and described above. Then a structure 42 is towed into towing position and the same operations of positioning are carried out as those already described. Instead of hoisting the structure from a platform, the structure 42 is hoisted from the end of the bridge 41, then fixed by connecting means 44, then the foot 47 is deposited on the ocean bed according to the same operations as shown in FIGS. 8*c* to 8*e*. Operations are carried out in the same way to position the structure 43 fastened to the preceding structure 41. The operation can then be repeated as often as desired, according to the desired length of the bridge.

For an installation on site according to the invention, it must be noted that a structure generally known as a "derrick-barge" is not necessary; it is simply necessary to provide slow speed lifting of the order of 300 tons.

From the point of view of naval support, the invention only requires the presence of two tugs and an assistance vessel.

According to the present invention, the limiting conditions of operation are imposed in practice by the possibilities of towing, and then by those of recovery of the auxiliary floats.

Of course, the invention is not limited to the embodiment illustrated and described above but covers on the contrary, all modifications, notably those relating to the general shape, the arrangement and the sizes of the various elements constituting the structure and necessary for its positioning according to the invention, as well as the different installations supported by said structure which can be of types other than a flare.

We claim:

1. A method of positioning a support structure adjacent to a petroleum platform located in an ocean, the support structure comprising a bridge having a first end which can support a flare or other external installation and a second end which can be connected above the water to the platform, and a biped tower hingedly connected to the bridge and being foldable to a vertical position for supporting the bridge, the said method comprising: folding the tower as a whole with respect to the bridge so as to bring the longitudinal axes of the tower legs substantially parallel to the longitudinal axis of the bridge whereby to facilitate towing of the support structure, the biped tower serving as a substantially horizontal support for the bridge during towing; providing the tower legs with pivoted, horizontally disposed, ballast dead men caissons also capable of serving as feet therefor; providing auxiliary removable floats for the tower legs at points remote from said feet; towing the folded support structure to the site where the platform is located; flexibly attaching said second end of the bridge to the platform; ballasting the dead men caissons so as to submerge them and fold the biped tower as a whole towards its vertical position while maintaining the said removable floats in operative condition; starting the ballasting of the said removable floats after the ballasting of the dead men caissons is terminated so as to drop said dead men caissons onto the ocean bed to serve as feet for the said biped tower in its vertical support position; mooring said bridge to said platform; and recovering said removable floats.

2. Method according to claim 1, wherein the ballasting of the dead men is completed with concrete.

3. Method for positioning an assembly for supporting outer installations of a petroleum platform, comprising positioning, according to the method of one of claims 1 or 2, a first structure comprising a biped tower supporting a bridge, the first end of said bridge being anchored to the petroleum platform, placing in position, according to the method of one of claims 1 or 2, in line with said first structure, one or several juxtaposed structures, a first end of the structure adjacent to the preceding structure being anchored to the second end of said preceding structure.

4. A support structure adapted to be located adjacent a petroleum platform located in an ocean, said support structure comprising: a bridge having a first end which can support a flare or other external installation and a second end having flexible means by which it can be connected above the water to the platform; a rigid biped tower hingedly connected to said bridge and including a pair of non-extensible tower legs, said tower being foldable as a whole from a substantially horizontal position beneath said bridge (as when the support structure is being towed) to a vertical position for supporting said bridge (as when the support structure has been towed to the site where the platform is located); and each of said tower legs having a foot provided with a pivoted ballastable caisson, each caisson having a pivot axis parallel to the axis of the hinge connection by which said bridge and said biped tower are joined.

5. Support structure for installations outside a petroleum platform comprising a rigid biped tower having non-extensible legs for supporting a bridge which supports at one of the ends of said installations, notably a flare, the bridge and the tower being connected by a pivot permitting the tower to be brought substantially horizontal beneath the bridge, the feet of the tower resting on ballastable caissons, wherein the feet of the tower are connected to said caissons by pivots with an axis parallel to that of the pivot connecting the bridge and the tower.

6. Structure according to claim 5, comprising at one end or at both ends, anchoring means for being connected to the platform and/or to another structure.

* * * * *